US008320780B2

(12) United States Patent
Nakajima et al.

(10) Patent No.: US 8,320,780 B2
(45) Date of Patent: Nov. 27, 2012

(54) IMAGE FORMING DEVICE AND DETACHABLE PROCESS UNIT

(75) Inventors: Keigo Nakajima, Nagoya (JP); Shunsuke Ishii, Toki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 326 days.

(21) Appl. No.: 12/749,775

(22) Filed: Mar. 30, 2010

(65) Prior Publication Data

US 2010/0303478 A1 Dec. 2, 2010

(30) Foreign Application Priority Data

May 29, 2009 (JP) ..... 2009-130904

(51) Int. Cl.
*G03G 15/00* (2006.01)

(52) U.S. Cl. ..... 399/13; 399/110; 399/111; 399/113

(58) Field of Classification Search ..... 399/13, 399/110, 111, 113
See application file for complete search history.

(56) References Cited

U.S. PATENT DOCUMENTS

| | | | | |
|---|---|---|---|---|
| 6,298,202 | B1 | 10/2001 | Fushiya et al. | |
| 6,751,428 | B2 * | 6/2004 | Okabe | 399/111 |
| 7,190,921 | B2 | 3/2007 | Ishii et al. | |
| 7,242,874 | B2 | 7/2007 | Tsusaka | |
| 7,298,990 | B2 * | 11/2007 | Nishimura | 399/113 |
| 2005/0053394 | A1 | 3/2005 | Ishii et al. | |
| 2005/0220461 | A1 | 10/2005 | Tsusaka | |
| 2005/0265736 | A1 * | 12/2005 | Seto et al. | 399/13 |
| 2007/0058993 | A1 * | 3/2007 | Horinoe | 399/13 |

FOREIGN PATENT DOCUMENTS

| | | | |
|---|---|---|---|
| JP | H4-157477 | A | 5/1992 |
| JP | H6-167845 | A | 6/1994 |
| JP | 2001-222204 | | 8/2001 |
| JP | 2002-244533 | | 8/2002 |
| JP | 2005-049524 | | 2/2005 |
| JP | 2005-049525 | A | 2/2005 |
| JP | 2005-077419 | | 3/2005 |
| JP | 2005-128137 | | 5/2005 |
| JP | 2005-292357 | A | 10/2005 |
| JP | 2005-345939 | A | 12/2005 |

OTHER PUBLICATIONS

JP Office Action dtd Mar. 8, 2011, JP Appln. 2009-130904, English translation.

* cited by examiner

*Primary Examiner* — Ryan Walsh
(74) *Attorney, Agent, or Firm* — Banner & Witcoff, Ltd.

(57) ABSTRACT

An image forming device has a main casing and a cartridge accommodating portion in which a combined unit of first and second cartridges can be loaded. The first cartridge includes a pressing member movable between a first position in which the second cartridge is removed from the first cartridge and a second position in which the second cartridge is combined with the first cartridge. A moving member supported on the main casing is movable between a third position in which the combined unit is unloaded from the main casing and a fourth position in which the combined unit is loaded in the main casing. The pressing member disposed in the second position presses the moving member to move to the fourth position. A determination unit does not start image forming operations until a position detector provided on the main casing detects that the moving member is in the fourth position.

12 Claims, 9 Drawing Sheets

IMAGE FORMING DEVICE AND DETACHABLE PROCESS UNIT

CROSS REFERENCE TO RELATED APPLICATION

This application claims priority from Japanese Patent Application No. 2009-130904 filed May 29, 2009. The entire content of the priority application is incorporated herein by reference.

TECHNICAL FIELD

The present invention relates to an image forming device, such as a laser printer, and a developing cartridge for use therein.

BACKGROUND

A conventional image forming device includes a main casing within which a process unit is detachably accommodated. In such an image forming device, the process unit is configured of a drum cartridge and a developing cartridge. The drum cartridge is detachably loadable in the main casing and includes a photosensitive drum. The developing cartridge is formed with a toner chamber for accommodating toner therein and is detachably mounted on the drum cartridge. In other words, the process unit can be separated into the drum cartridge and the developing cartridge, and the process unit as a whole is detachably loadable in the main casing of the image forming device.

The developing cartridge includes a developing roller for supplying the accommodated toner to the photosensitive drum. The drum cartridge has a drum frame on which a lever is provided as a pressing member so that the developing roller can be pressed against the photosensitive drum.

SUMMARY

In the above-described image forming device, when the process unit is unloaded from the main casing for a maintenance purpose, the process unit is separated into the drum cartridge and the developing cartridge. At this time, a careless user may bring the process unit back to the main casing in an incomplete state, i.e., only either one of the drum cartridge and the developing cartridge may possibly be brought back to the main casing.

Further, in case of replacing the developing cartridge with a new one in the process unit, the drum cartridge, which should not be replaced, may be thrown away together with the old developing cartridge. If this is the case, a new developing cartridge alone may be loaded in the main casing without the necessary drum cartridge.

In either case, the conventional image forming device cannot detect that the loaded process unit is incomplete since the developing cartridge is detachably mountable in the main casing via the drum cartridge. In other words, the above-described image forming device can hardly, if not impossible, distinguish a state where the drum cartridge alone is mounted in the main casing from a state where the drum cartridge is mounted in the main casing with the developing cartridge mounted on the drum cartridge.

As a result, the image forming device is allowed to start image forming operations, although a paper jam will result, even though either one of the drum cartridge and developing cartridge has not been loaded. Occurrence of the paper jam makes the user realize at that time that there is something wrong with the loaded process unit, i.e., either only one of the drum cartridge and the developing cartridge has been loaded in the main casing. However, desirably, occurrence of such error should be prevented as early as possible before a paper jam actually happens.

In view of the foregoing, it is an object of the present invention to provide an image forming device and a drum cartridge that would not allow image formation to be started until a complete process unit is detected to have been loaded in the image forming device.

In order to attain the above and other objects, the image forming device in accordance with the invention includes a main casing, a cartridge accommodating portion, a moving member, a position detector, and a determination unit. The cartridge accommodating portion is configured to detachably accommodate a first cartridge and a second cartridge. The second cartridge is able to be detachably combined with the first cartridge to form a combined unit. The first cartridge is provided with a pressing member movable between a first position and a second position. The pressing member is in the first position when the second cartridge is removed from the first cartridge, and in in the second position when the second cartridge is perfectly combined with the first cartridge. The moving member is supported on the main casing to be movable between a third position and a fourth position. The moving member is in the third position when the combined unit is unloaded from the main casing, and in the fourth position when the combined unit is loaded in the main casing. The pressing member disposed in the second position presses the moving member to move to the fourth position. The position detector is provided on the main casing and is configured to perform position detection of the moving member. The determination unit is configured not to start image forming operations until the position detector detects that the moving member is in the fourth position.

According to another aspect of the invention, there is provided a drum cartridge for an image forming device, the drum cartridge including a frame, a photosensitive drum, a pressing member, and a projection member. The frame has a mounting portion on which a developing cartridge is detachably mountable. The developing cartridge includes a developing roller. The photosensitive drum is rotatably supported on the frame. Developer is supplied to the photosensitive drum by the developing roller. The pressing member is supported on the frame at a position upstream of an accessing path along which the drum cartridge is loaded in the image forming device. The pressing member is movable between a first position and a second position. The pressing member is in the first position when the developing cartridge is dismounted from the drum cartridge and in the second position when the developing cartridge is mounted on the drum cartridge. The pressing member urges the developing roller against the photosensitive drum when the pressing member is in the second position. The projection member is supported on the pressing member and projects out of the frame. A position of the projection member is movable when the pressing member is moved from the first position to the second position.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
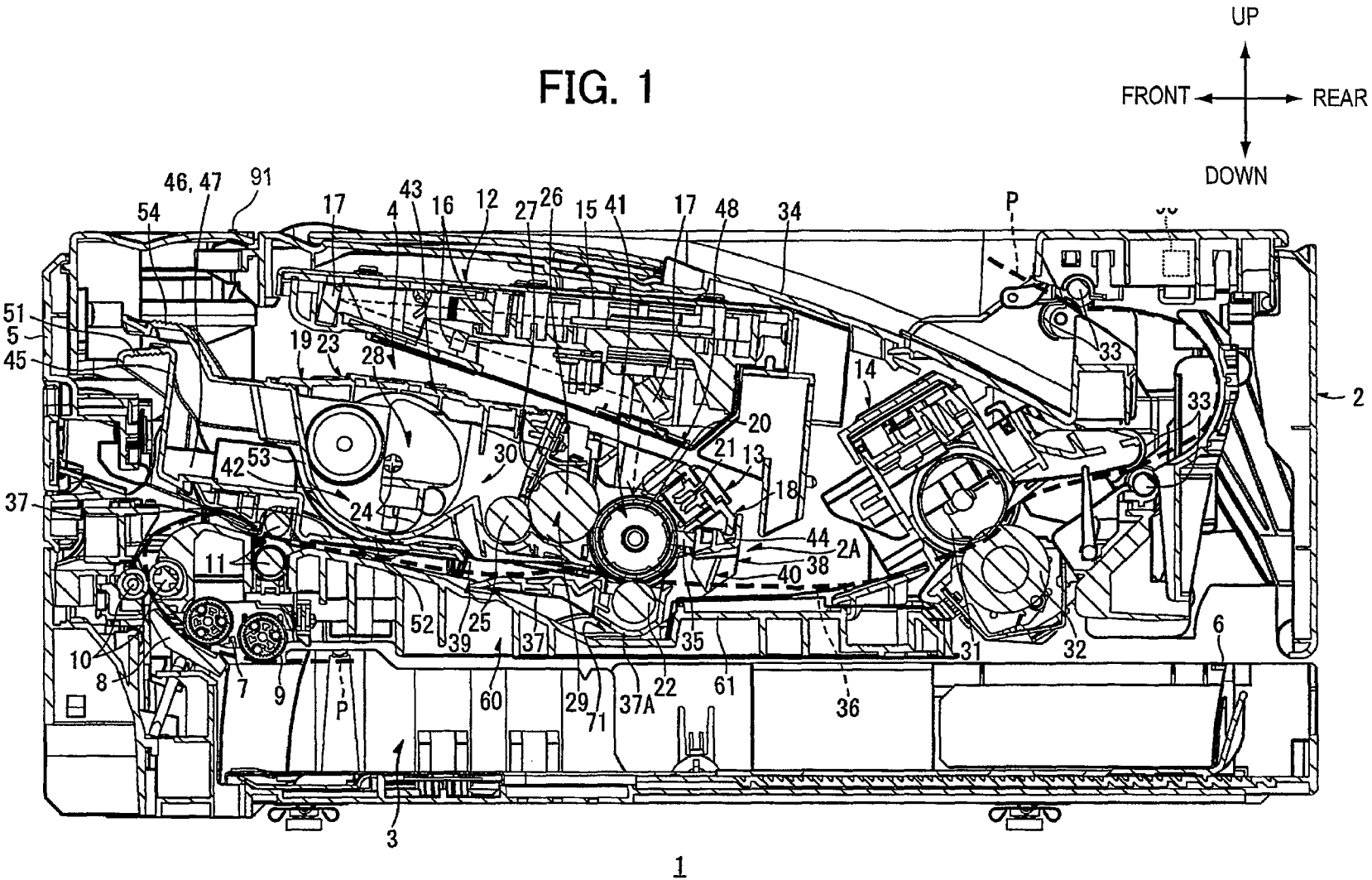
FIG. 1 is a vertical cross-sectional view showing a laser printer as one example of image forming devices in accordance with the invention.

An embodiment of the invention will be described with reference to the accompanying drawings. As shown in FIG. 1, the printer 1 has a main casing 2 in which a feeder section 3 and an image forming section 4 are disposed. In the front wall of the main casing 2, a front cover 5 is hinged at the lower portion thereof to be capable of being opened. When the front cover 5 is opened, it is capable of accessing to the internal space 2A of the main casing 2. In this state, a process unit 13 (to be described later) can be loaded in the main casing 2. When the front cover 5 is shut, accessing to the internal space 2A of the main casing 2 becomes impossible.

In the following description, one end of the main casing 2 in which the front cover 5 is provided (left side in FIG. 1) will be referred to as "front side", and the opposite side thereof (right side in FIG. 1) as "rear side". The terms "right (side)" and "left (side)" will be used to refer to the side of the printer 1 as viewed from front. The terms "front", "rear", "right", "left" and the like will also be used for the process unit 13 and a developing cartridge 9 (to be described later) to refer to the same sides as in the main casing 2. The expression "widthwise direction" may be used to mean the left-to-right direction.

The feeder section 3 includes a sheet supply tray 6, a sheet feed roller 7, a sheet feed pad 8, a pickup roller 9, a pair of conveying rollers 10, and a pair of registration rollers 11. Sheets of paper P serving as a recording medium are stacked in the sheet supply tray 6. The topmost sheet in the sheet supply tray 6 is fed toward the sheet feed roller 7 and the sheet feed pad 8 by the pickup roller 9. The sheet P thus fed out is fed in between the sheet feed droller 7 and the sheet feed pad 8, and then fed into a nip between the pair of conveying rollers 10. The sheet P having passed between the pair of conveying rollers 10 is fed into a nip between the registration rollers 11. The registration rollers 11 feed the sheet P toward a transfer position (to be described later) in the image forming section 4 at a prescribed timing.

The image forming section 4 includes a scanner unit 12, the process unit 13 and a fixing unit 14. The scanner unit 12 is disposed at the upper portion of the main casing 2. The scanner unit 12 includes a laser source (not shown), a polygon mirror 15, a plurality of lenses 16 and a plurality of reflection mirrors 17. As shown by a dotted line, the scanner unit 12 irradiates a laser beam toward a photosensitive drum 20 (to be described later) contained in the process unit 13.

The process unit 13 is disposed beneath the scanner unit 12. The process unit 13 includes a drum cartridge 18 as one example of a photosensitive drum cartridge, and the developing cartridge 19 detachably mounted on the drum cartridge 18. As descried, the drum cartridge 18 and the developing cartridge 19 can be loaded in or unloaded from the main casing 2 through loading or unloading the process unit 13.

The photosensitive drum 20 is rotatably supported in the drum cartridge 18. The drum cartridge 18 includes a scorotron type charger 21, a transfer roller 22, and a cleaning member 35, which are disposed around the periphery of the photosensitive drum 20. The developing cartridge 19 has a developer housing 23 in which disposed are an agitator 24, a supply roller 25, a developing roller 26, and a thickness regulating blade 27.

The developer housing 23 includes a toner accommodating chamber 28 and a developing chamber 29 which are arranged in the front-to-rear direction. The toner accommodating chamber 28 and the developing chamber 29 are in communication with each other at a communication port 30. The toner accommodating chamber 28 accommodates non-magnetic single-component, positively-chargeable polymerization toner. The agitator 24 is rotatably disposed within the toner accommodating chamber 28.

The supply roller 25 is rotatably disposed within the developing chamber 29 behind the communication port 30. The developing roller 26 is rotatably disposed within the developing chamber 29. The supply roller 25 is disposed in the rear side of the developing roller 26 and both are held in pressure contact with each other. The thickness regulating blade 27 is a plate-shaped member and extends in the left-to-right direction. The thickness regulating member 27 has a base portion fixed to the developer housing 23 and a free end held in pressure contact with the peripheral surface of the developing roller 26.

The toner in the toner accommodating chamber 28 is agitated by the agitator 24 and conveyed to the supply roller 24 disposed in the developing chamber 29 through the communication port 30. The toner conveyed to the supply roller 25 is then delivered to the developing roller 26. At this time, the toner is frictionally charged to positive polarity at a portion between the supply roller 25 and the developing roller 26 to which a developing bias is applied. In this manner, the toner supplied to the developing roller 26 is subject to a thickness regulation by the thickness regulating blade 27 so that the toner layer bore on the peripheral surface of the developing roller 26 has a predetermined thickness.

On the other hand, as the photosensitive drum 20 rotates, the surface thereof is uniformed charged to positive polarity by the charger 21. A laser beam emanated from the scanner unit 12 is irradiated onto the positively charged surface of the photosensitive drum 20 as indicated by a dotted line. The portions onto which the laser beam is irradiated form an electrostatic latent image. The laser beam is modulated based on image data and thus an electrostatic latent image corresponding to the image data is formed on the surface of the photosensitive drum 20.

Rotations of the photosensitive drum 20 bring the electrostatic latent image to the position of the developing roller 26. The positively charged toner bore on the developing roller 26 is attracted to the electrostatic latent image so that the electrostatic latent image is visualized with the toner image. The toner image bore on the surface of the photosensitive drum 20 is moved to a transfer position where the transfer roller 22 is located for allowing the toner image to be transferred to the sheet of paper P.

After the toner image has been transferred to the sheet of paper P, toner remaining on the photosensitive drum 20 is removed or collected by the developing roller 26. The cleaning member removes paper dust or paper powder which comes from the sheet of paper P and adhered to the surface of the photosensitive drum 2.

The fixing unit 14 is disposed at the rear side of the process unit 13. The fixing unit 14 includes a heat roller 31 and a pressure roller 32 which is urged upward to the heat roller 31 to be in pressure contact with the heat roller 31.

The sheet of paper P with the toner image thereon is brought into a nip between the heat roller 31 and the pressure roller 32 and passes therethrough, thereby fixing the toner image on the sheet of paper P with the pressure and heat applied thereto.

The sheet of paper P to which the toner image is fixed is conveyed toward the discharge roller 33 and discharged onto the discharge tray 34 formed on the upper surface of the main casing 2.

A sheet conveying path 36 is formed within the main casing 2 for conveying the sheet of paper P therealong. The locus of the sheet of paper P being conveyed from the sheet supply tray 6 to the discharge tray 34 is indicated by a thick dotted line in FIG. 1. It can be understood that the thick dotted line is in coincidence with the sheet convey path. The sheet conveying path 36 is in a reversed S-shaped structure as viewed from the widthwise direction. When the sheet of paper P is conveyed along the sheet conveying path 36, the paper P passes the pickup roller 9, between the sheet supply roller 7 and the sheet supply pad 8, between the pair of conveying rollers 10, between the pair of registration rollers 11, the transfer position, between the heat roller 31 and the pressure roller 32, and the discharge roller 33 in the stated order. As described, the sheet conveying path 36 connects the sheet supply tray 6 and the discharge tray 34.

Next, each of the drum cartridge 18 and the developing cartridge 19 will be described. As shown in FIG. 1, the drum cartridge 18 has a drum housing 38 in which the photosensitive drum 20, charger 21, transfer roller 22 and cleaning member 35 are accommodated.

Figure 2:
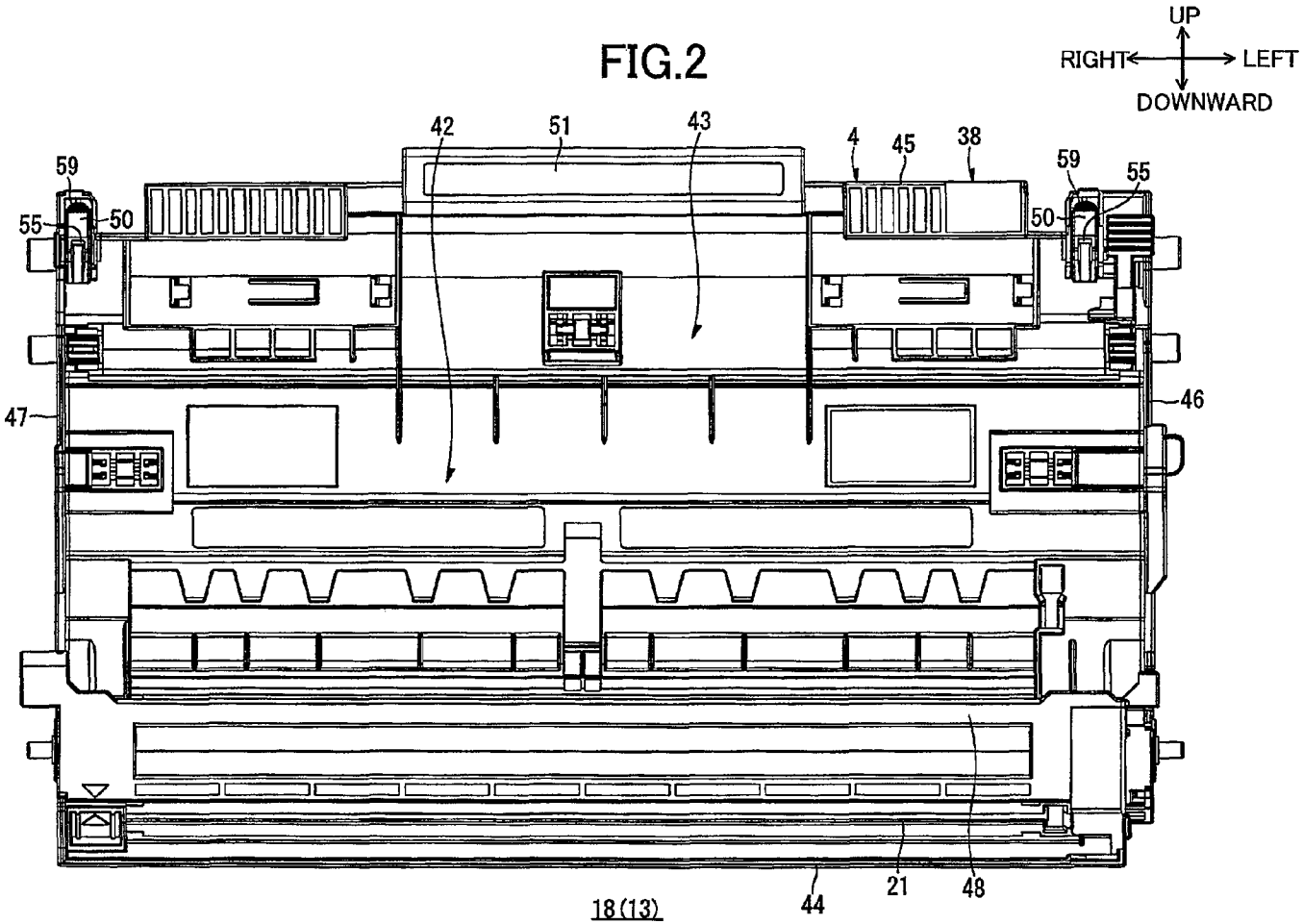
FIG. 2 is a plan view showing a drum cartridge used in the laser printer shown in FIG. 1.

As can be understood from FIGS. 1 and 2, the drum housing 38 extends in the widthwise direction and is a hollow box that is flattened shape in the vertical or up-to-down direction. An inlet port 39 in communication with the internal space of the drum housing 38 is formed in the bottom wall 37 of the drum housing 38 at a central position in the front-to-rear direction. An outlet port 40 which is also in communication with the internal space of the drum housing 38 is formed in the rear wall 44 of the drum housing 38.

Both the inlet port 39 and the outlet port 40 have a width wider than the paper width. The sheet of paper P forwarded by the registration rollers 11 enters into the drum housing 38 from the inlet port 39. After passing through the transfer position, the sheet of paper P moves from the outlet port 40 to the fixing unit 14. As is apparent from the above description, the channel between the inlet port 39 and the outlet port 40 is a part of the sheet conveying path 36. Another part of the sheet conveying path 36 is located in the front side with respect to the inlet port 39, where the upper registration roller 11 is rotatably disposed.

The internal space of the drum housing 38 is partitioned into the rear side drum accommodating chamber 41 and a cartridge accommodating chamber 42. Both the drum accommodating chamber 41 and the cartridge accommodating chamber 42 are in communication with each other. The drum accommodating chamber 41 is defined by a ceiling wall 48, bottom wall 37, left wall 46 and right wall 47 of the drum housing 38 and includes a first space at the rear side of the cartridge accommodating chamber 42 and a second space surrounded by the rear wall 44.

The drum accommodating chamber 41 accommodates the photosensitive drum 20, charger 21, transfer roller 22, and cleaning member 35. The photosensitive drum 20 is in a cylindrical shape having a center axis extending in the widthwise direction. In other words, the axial direction of the photosensitive drum 20 is in coincidence with the widthwise direction. Both ends in the widthwise direction of the photosensitive drum 20 are rotatably supported on the left wall 46 and right wall 47 of the drum housing 38. A front part of the photosensitive drum surface is exposed to face the cartridge accommodating chamber 42. As will be describe later with reference to FIG. 4, each of the left wall 46 and right wall 47 is formed with a guide groove 49 penetrating in the widthwise direction. As viewed from the widthwise direction, the guide slots 49 are formed in the left wall 46 and the right wall 47 at the upper end portion thereof and also at the central portion thereof in the front-to-rear direction. The guide slots 49 extend rearward and downward to a position close to the photosensitive drum 20.

The transfer roller 22 is disposed below the photosensitive drum 20 and held in pressure contact with the photosensitive drum 20. The transfer roller 22 has a longitudinal axis extending in the widthwise direction. Both axial ends of the transfer roller 22 are rotatably supported on the left wall 46 and right wall 47 of the drum housing 38. A part 37A of the bottom wall of the drum housing 38 is arcuately protruded downward to conform to the shape of the lower peripheral surface of the transfer roller 22.

The cleaning member 35 is disposed at the rear side of the photosensitive drum 20 and secured to the front side surface of the rear wall 44. The cleaning member 35 is held in contact with the photosensitive drum 20. The charger 21 is disposed at the rear and diagonally upward position with respect to the photosensitive drum 20. The charger 21 is supported on the upper portion of the rear wall 44 to be in spaced-apart relation with the surface of the photosensitive drum 20 and disposed in confrontation with the surface of the photosensitive drum 20.

The cartridge accommodating chamber 42 is a part of the space defined by the ceiling wall 48, bottom wall 37, left wall 46 and right wall 47, and surrounded by the part in the front side of the drum accommodating chamber 41 and the front wall 45 of the drum housing 38. A part of the ceiling wall 48 defining the cartridge accommodating chamber 42 is formed with a continuous cutout portion which serves as a loading port 43. The cartridge accommodating chamber 42 is exposed toward upward from the loading port 43.

The developing cartridge 19 passes through the loading port 43 when the same is mounted on or dismounted from the drum cartridge 18. The developing cartridge 19 mounted on the drum cartridge 18 is accommodated in the cartridge accommodating chamber 42. A pair of pressing members 50 is provided to the front wall 45 of the drum housing 38. The pressing members 50 are provided for urging the developing cartridge 19 mounted on the drum cartridge 18 rearward against the photosensitive drum 20. Note that the pressing member 50 is not shown in FIG. 1. As shown in FIG. 2, the pressing members 50 are provided one at a right end and the other at a left end on the rear surface, i.e., the surface facing the cartridge accommodating chamber 42, of the front wall 45. In other words, the pressing members 50 are arranged in spaced apart relation in the widthwise direction of the front edge portion of the cartridge accommodating chamber 42.

Figure 3:
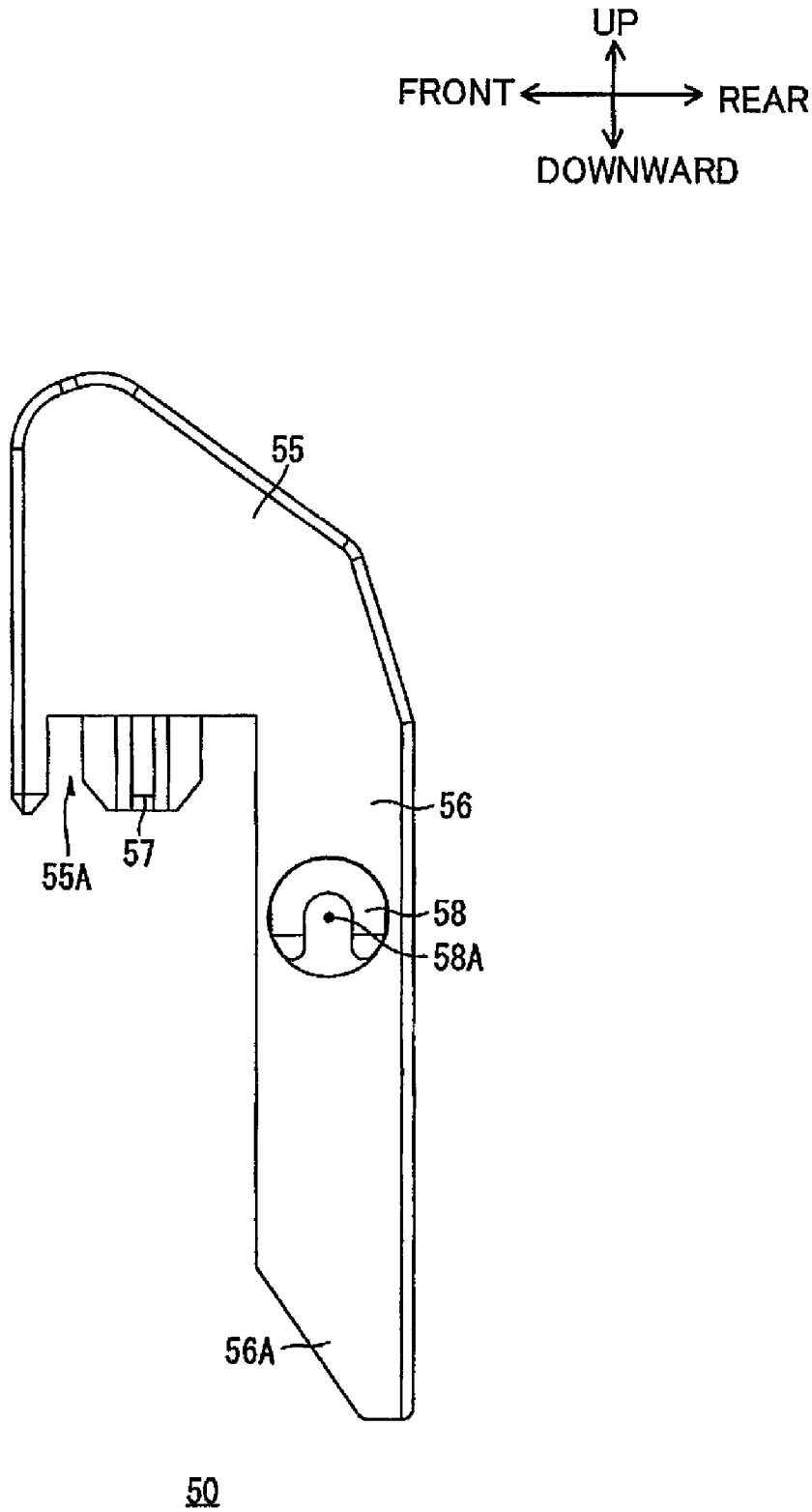
FIG. 3 is a right side view showing a pressing member used in the laser printer shown in FIG. 1.

FIG. 3 shows the right side view of the pressing member 50. The following description about the pressing member 50 will be made based on the posture depicted in FIG. 3. The pressing member 50 is of substantially a reversed (upside down) J-shape as viewed from the widthwise direction. From the functional viewpoint, the pressing member 50 can be divided into a pressing part 55 at an upper portion and an extension portion 56 extending downward from the pressing part 55, although these two parts are integrally formed as one block.

As viewed from the widthwise direction, the pressing part 55 is of substantially a triangular shape with a front-to-rear length becoming thinner in higher or upward levels. The topmost portion of the pressing part 55 is rounded. The rear edge line of the pressing part 55 extends diagonally downward from the topmost rounded portion, and is bent and further extends diagonally downward with a sharper slope to the upper end position of the extension portion 56. The front edge of the pressing part 55 extends substantially downward from the topmost rounded portion.

The pressing part 55 is formed with a concave portion 55A at the lower surface thereof. A downwardly projecting boss 57 is formed in the concave portion 55A to be integral with the pressing part 55. The extension portion 56 extends linearly downward from the lower end of the pressing part 55. The vertical or longitudinal length of the extension portion 56 is about two to three times as long as the vertical length of the pressing part 55. The extension portion 56 has a lower end portion 56A defined by a rear surface extending downward and a front surface extending diagonally downward. Stated differently, the extension portion 56 is of a cutter-knife shape and its knife edge portion is such a shape that its front-to-rear length becomes smaller as the vertical level goes down. A pressing shaft 58 is integrally formed with the extension portion 56. The pressing shaft 58 extends in the widthwise direction and is provided in a position slightly upper from the vertical center of the extension portion 56.

Figure 4:
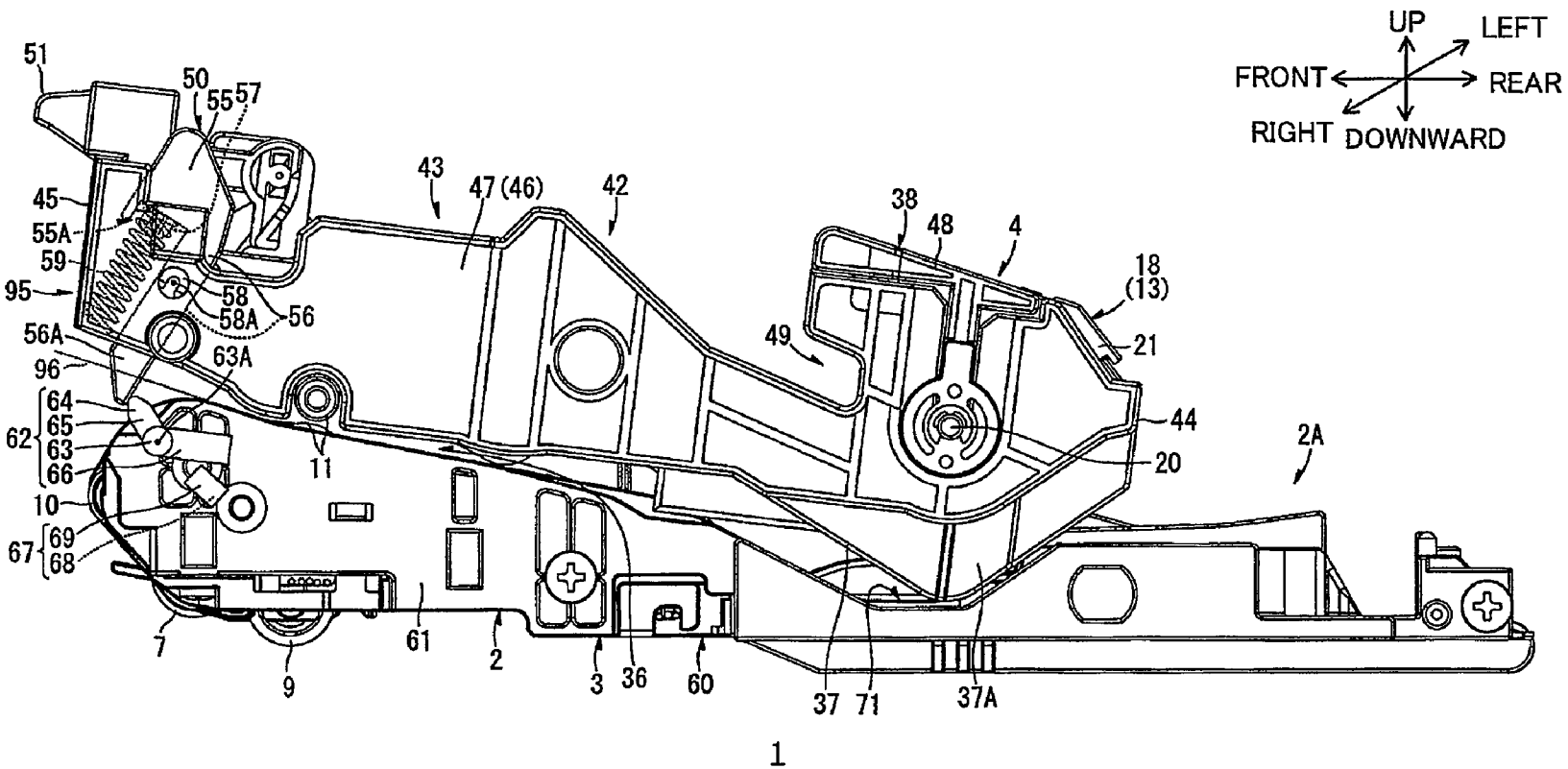
FIG. 4 is a right side view showing a major portion of a process unit used in the laser printer shown in FIG. 1.
Figure 5:
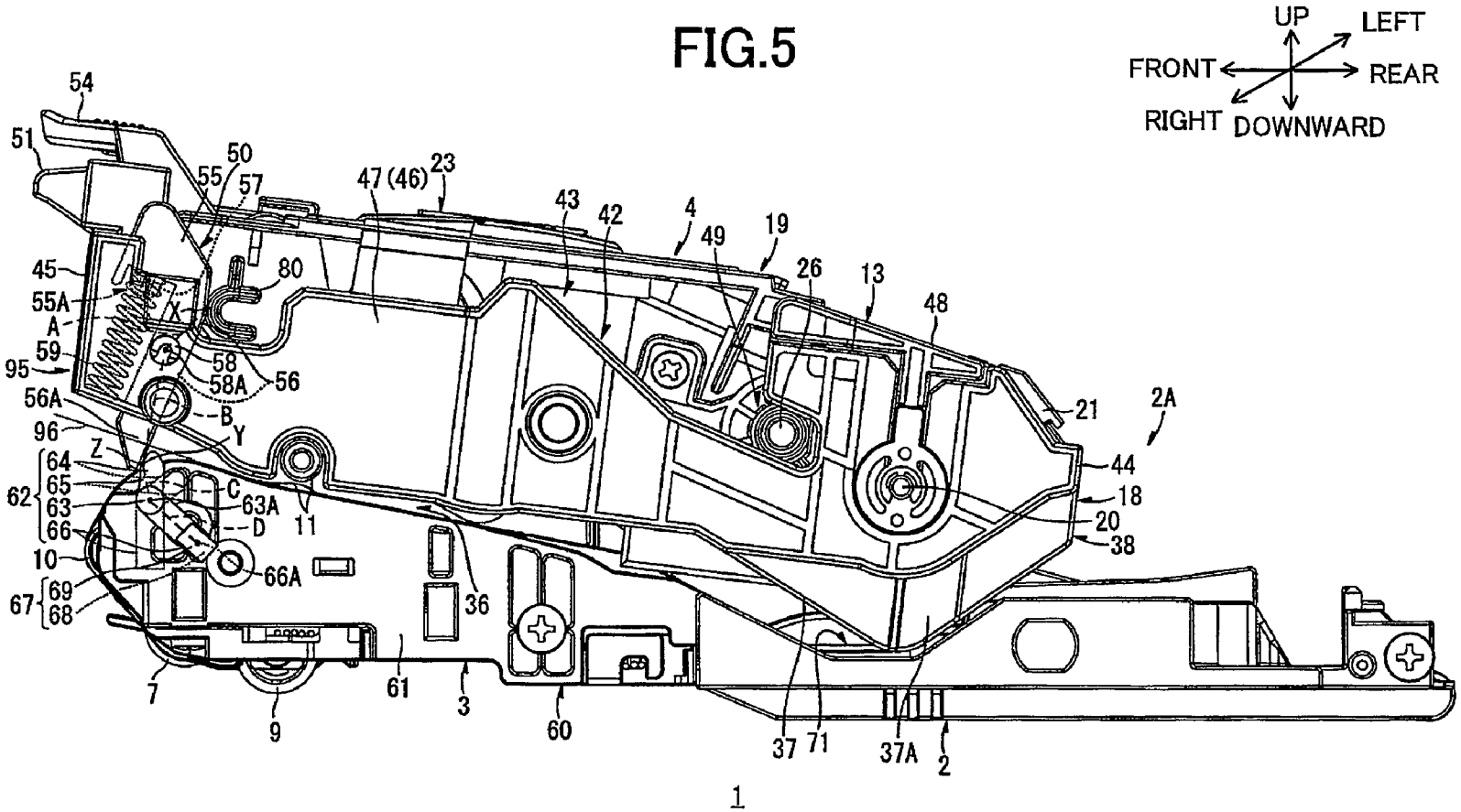
FIG. 5 is a right side view of the process unit showing a drum cartridge mounted on a drum cartridge.

FIG. 4 shows the drum cartridge 18 from which the developing cartridge 19 is detached. On the other hand, FIG. 5 shows the developing cartridge 19 mounted on the drum cartridge 18. As described above, the pressing members 50 are provided at the rear side surface of the front wall 45 of the drum housing 38 at the widthwise end portions (see FIG. 2). The pressing member 50 is rotatable about the pressing shaft 58 which is supported by the right wall 46 and the left wall 47.

As to the right side pressing member 50, the boss 57 extends toward a right lower corner where the right wall 47, front wall 45 and bottom wall 37 join together. A coil spring 59 is interposed between the boss 57 and the right lower corner. Similarly, the boss 57 of the left side pressing member 50 extends toward a left lower corner where the left wall 46, front wall 45 and bottom wall 37 join together. Another coil spring 59 is interposed between the boss 57 and the left lower corner. The coil springs 59 urge the pressing member 55 in a rear upper direction, causing the pressing member 50 to incline in the rear upper direction.

The position of each pressing member 50 when placed as shown in FIG. 4 will be referred to as the "first position". Each pressing member 50 is placed in the first position by virtue of the associated coil spring 59. The lower portion of the extension portion 56 of each pressing member 50 protrudes downward from the bottom wall 37 of the drum housing 38 to be outside the drum housing 38. When the pressing member 50 is in the first position, the lower portion 56A of the extension portion 56 projects toward the front lower side of the drum cartridge 18.

On the other hand, when the developing cartridge 19 is mounted on the drum cartridge 18, the pressing member 50, which has been stayed in the first position, is rotated counterclockwise for a predetermined amount as viewed from the right side of the drum cartridge 18, as shown in FIG. 5. The rotated position of the pressing member 50 will be referred to as the "second position". Briefly, the pressing member 50 is rotatingly moved between the first position and the second position.

A drum grip 51 is integrally formed in the front upper portion of the front wall 45 and extends in the front side. The drum grip 51 is grasped by the user when the drum cartridge 18 (process unit 13) is loaded in the main casing 2.

The developer housing 23 of the developing cartridge 19 is elongated in the widthwise direction and a vertically flat shaped and hollow box. The developing cartridge 19 has a size and shape to be fittedly received at the cartridge accommodating chamber 42.

A pressed member 80 is integrally formed to each of the left and right side surfaces of the developer housing 23 at their front end portions. The pressed member 80 is a boss projecting outward in the widthwise direction and is of substantially C-shaped with the rear side being open as viewed from the widthwise direction. The toner accommodating chamber 28 and the developing chamber 29 are disposed in the developer housing 23 and the former is located in front of the latter. The toner accommodating chamber 28 is of substantially circular shape as viewed from the widthwise direction. The circular shape of the toner accommodating chamber 28 follows the rotation locus of the agitator 24. The bottom wall 52 of the developing housing 23 is downwardly circularly protruded to receive the lower portion of the toner accommodating chamber 28.

The front wall 53 of the developer housing 23 extends upward from the front end of the bottom wall 52. A developer grip 54 is integrally formed with the front wall 53 at the upper end portion thereof. The developer grip 54 extends frontward and upward from the upper end portion of the front wall 53. The developer grip 54 is grasped by the user when the developing cartridge 19 is mounted on or dismounted from the drum cartridge 18 or when the process unit 13 is loaded in or unloaded from the main casing 2.

Figure 7:
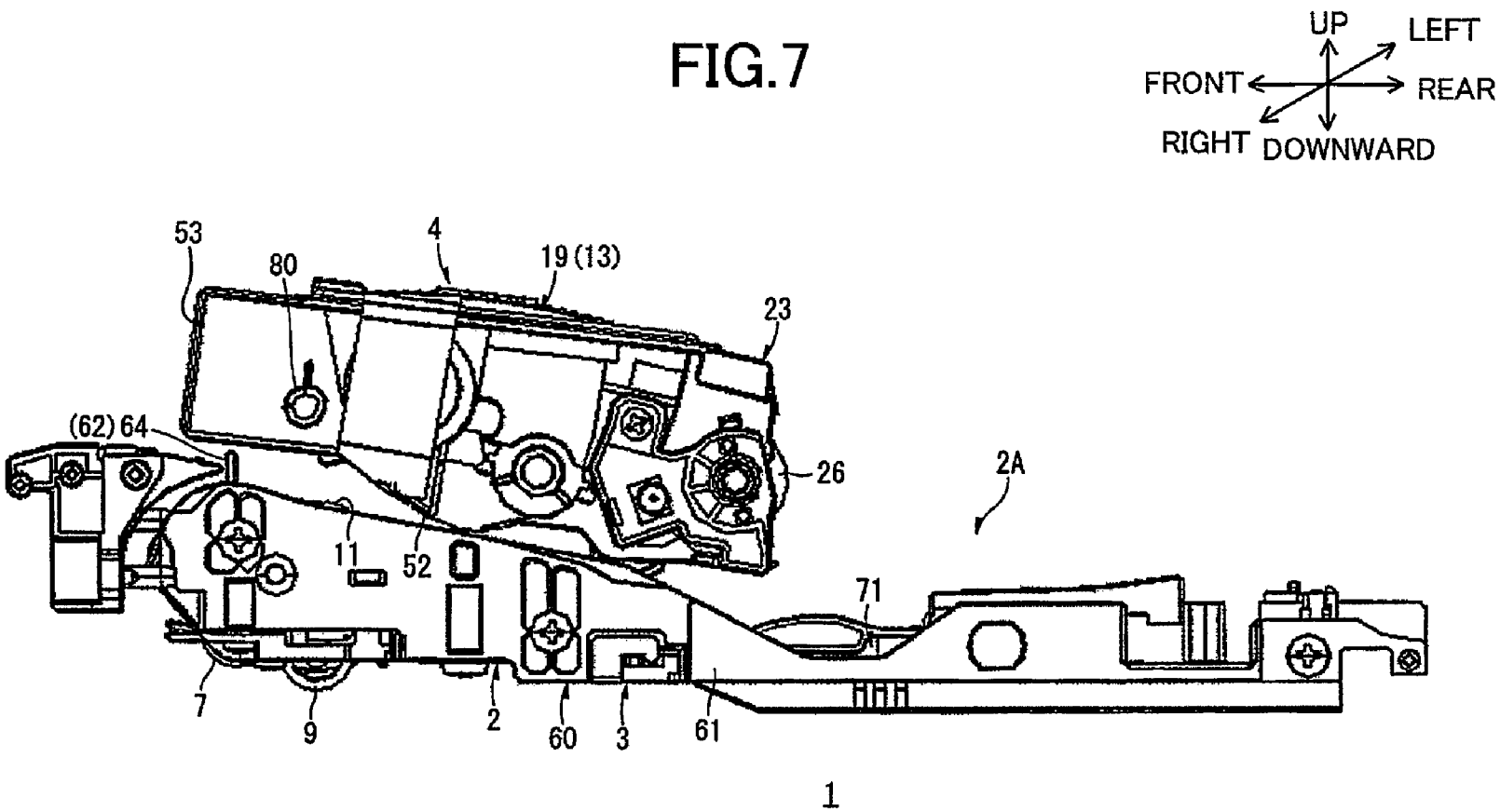
FIG. 7 is a right side view showing a major portion of the developing cartridge when only the developing cartridge is mounted to the laser printer shown in FIG. 1.

Rotational shafts of the agitator 24, supply roller 25 and the developing roller 26 extend in the widthwise direction. As shown in FIG. 5, the axial ends of the rotation shaft of the developing roller 26 project outward from the developer housing 23. As best shown in FIG. 7, the rear peripheral surface of the developing roller 26 is partly projected from the developer housing 23. When the developing cartridge 19 is mounted on the drum cartridge 18 and received at the cartridge accommodating chamber 42, the rear peripheral surface of the developing roller 26 is brought into contact with the front peripheral surface of the photosensitive drum 20 having been partly projected into the cartridge accommodating chamber 42. With this structure, toner bore on the developing roller 26 can be supplied to the electrostatic latent image formed on the surface of the photosensitive drum 20.

Mounting the developing cartridge 19 on and dismounting the same from the drum cartridge 18 are performed at places outside the main casing 2. Specifically, in order to mount the developing cartridge 19 on the drum cartridge 18, the developing cartridge 19 is moved to the upper position of the drum cartridge 18 while grasping the developing grip 54. Then, the developing cartridge 19 is further moved to rear and lower side and pushed into the cartridge accommodating chamber 42 through the loading port 43 of the drum housing 38. At this time, the axial ends of the rotation shaft of the developing roller 26 are brought into engagement with the guide groove 49 formed in the drum. housing 38 to allow the developing roller 26 to be guided by the guide groove 49. The developing cartridge 19 is thus moved to the rear lower side, resulting in accommodation into the cartridge accommodating chamber 42.

As the developing cartridge 19 is about to be received at the cartridge accommodating chamber 42, the left and right pressed members 80 (see FIG. 5) formed to the developing cartridge 19 are brought into abutment with the corresponding pressing members 55 held in the first position, causing the pressing members 50 to start rotating counterclockwise against the urging force imparted thereon by the coil springs 59 as viewed from the right side.

After that, as shown in FIG. 5, when the axial ends of the rotation shaft of the developing roller 26 have reached to the deepest portion (rear end portion) of the guide groove 49, the developing cartridge 19 is no longer movable. This completes loading of the developing cartridge 19 into the cartridge accommodating chamber 42. At this time, rotations of the pressing members 50 are stopped and the pressing members 50 are brought to the second position shown in FIG. 5. With the operation described above, fabrication of the process unit is complete for ready to use.

When the developing cartridge 19 is mounted on the drum cartridge 18, the developing cartridge 19 is positioned at the bottom wall 37 of the drum housing 38, and the rotation shaft of the developing roller 26 engages the deepest portion of the guide groove 49. As such, the developing cartridge 19 is vertically positioned relative to the drum cartridge 18

The pressing members 50 are upwardly oriented in a larger degree in the second position than in the first position. When the pressing members 50 are in the second position, the pressing portion 55 is oriented to the rear side in a degree larger than when the pressing members 50 are in the first position (see FIG. 4). The lower portion 56A of the extension portion 56 protruding downward from the bottom wall 37 of the drum housing 38 is oriented to the rear side in a larger degree in the first position than in the second position. The urging force of the coil springs 59 is still imparted upon the pressing members 50 located at the second position, thus potential movability of the pressing members 50 to the first position is outstanding. The pressing portions 55 of the pressing members 50 are biased to move backward and thus urge the pressed members 80 rearward.

The developing cartridge 19 mounted on the drum cartridge 18 is urged rearward by the urging force applied by the pressing members 50 to the pressed members 80, resulting that the developing roller 26 is held in pressure contact with the photosensitive drum 20 accommodated in the drum cartridge 18. That is, the pressing members 50 serve to urge the developing roller 26 against the photosensitive drum 20 in the second position. The developing cartridge 19 is urged rearward by the pressing members 50 and the developing roller 26 disposed in the front side of the photosensitive drum 20 is in pressure contact with the photosensitive drum 20, thereby achieving positioning of the developing cartridge in the front-to-rear direction relative to the drum cartridge 18.

When the developing cartridge 19 is dismounted from the drum cartridge 18, the developing cartridge 19 is pulled to the front upward direction while grasping the developer grip 54. Dismounting the developing cartridge 19 from the drum cartridge 18 completes when the developing cartridge 19 is lifted through the loading port 43 formed in the drum housing 38. Upon completion of dismounting the developing cartridge 19, the pressing members 50 return to the first position (see FIG. 4) by virtue of the urging force of the coil springs 59.

As shown in FIG. 1, the feed unit 60 is disposed in the internal space 2A of the main casing 2. The feed unit 60 is vertically sandwiched by the sheet supply tray 6 and the process unit 13. The feed unit 60 includes the sheet supply roller 7, pickup roller 9, rear-side conveying roller 10, lower-side registration roller 11 and unit frame 61 for rotatably supporting those rollers. The feed unit 60 is a part of the feeder section 3.

The unit frame 61 is a hollow, plate-shaped member that is substantially rectangular in plan view. Specifically, the unit frame 61 has a widthwise length slightly longer than that of the sheet of paper P, and a longitudinal length being about two third (⅔) with respect to the front-to-rear length of the sheet supply tray 6. The thickness of the unit frame 61 is held even over the entire length, however, the front edge portion is slightly thicker than the remaining part. The front edge portion of the unit frame 61 has an arcuate cross-section protruding frontward as viewed from the widthwise direction.

The sheet feed roller 7 and the pickup roller 9 are supported on the lower surface of the front end portion of the unit frame 61, the rear side conveying roller 10 is supported on the front surface of the front end portion of the unit frame 61, and the lower side registration roller 11 is supported on the upper surface of the front end portion of the unit frame 61. On the other hand, the front side conveying roller 10 and the sheet feed pad 8 are supported on the front wall of the main casing 2. The upper side registration roller 11 is supported on the drum cartridge 18 as described previously.

The feed unit 60 is integrally formed with the main casing 2. A part of the conveying path 36 is defined by a space between the feed unit 60 and the front wall of the main casing 2 and between the feed unit 60 and the process unit 13. The process unit 13 loaded in the main casing 2 is positioned relative to the main casing 2 when the process unit 13 is placed on the feed unit 60. Specifically, a downwardly protruded portion 71 is formed substantially centrally in the front-to-rear direction in the upper surface of the unit frame 61 of the feed unit 60. The downwardly protruded portion 37A formed in the bottom wall 37 of the drum housing 38 is fittingly placed in the downwardly protruded portion 71 of the unit frame 61. The process unit 13 fitted to the unit frame 61 is thus positioned relative to the main casing 2.

A moving member 62 (indicated by a dotted line in FIG. 6) is provided on the upper surface of the unit frame 61 at the front end thereof and also at the front side of the lower side registration roller 11, i.e., the upstream side in the sheet conveying direction. In FIG. 5, the pressing member 50 is depicted with hatching.

The moving member 62 is formed integrally from a detection shaft 63 extending in the widthwise direction within the unit frame 61, a first segment 64 at the left end of the detection shaft 63, a second segment 65 at the right end of the detection shaft 63, and a third segment 66 downwardly projected from the center of the detection shaft 63. The third segment 66 serves as a detected section.

The detection shaft 63 is disposed below the right side of the conveying path 36 formed between the process unit 13 and the feed unit 60. The detection shaft 63 is rotatably supported by the unit frame 61, and the moving member 62 is rotatable about the detection shaft 63.

The first segment 64 of the moving member 62 is a rod-shaped member projecting upward from the detection shaft 63. The upper end of the first segment 64 is within the conveying path 36. The first segment 64 is positioned upstream of the registration rollers 11 and downstream of the conveying roller 10 with respect to the conveying direction of the sheet of paper P (see FIG. 1).

The second segment 65 of the moving member 62 is a rod-shaped member projecting upward from the detection shaft 63. The second segment 65 is spaced apart rightward from the conveying path 36 and the upper portion of the second segment 65 is located above the unit frame 61. The third segment 65 is also a rod-shaped member and is located within the unit frame 61. A position detector 67 is disposed within the unit frame 61, which operates in cooperation with the third segment 66.

The position detector 67 includes a light emitting section 68 and a light receiving section 69. The light emitting section 68 and the light receiving section 69 are upstanding posture on the lower wall of the unit frame 61 and arranged in spaced-apart relation with each other in the widthwise direction. The light emitting section 68 and the light receiving section 69 are in confrontation with each other and are not in contact with the moving member 62. The light emitting section 68 emits detection light as indicated by a dotted line in FIG. 6 and the light receiving section 69 receives the detection light if a light path 70 from the light emitting section 68 to the light receiving section 69 is not interrupted.

Depending upon the rotated position of the moving member 62, the third segment 66 of the moving member 62 is either placed between the light emitting section 68 and the light receiving section 69 to interrupt the light path 70 or placed out of the light path 70 to allow the detection light to receive at the light receiving section 69. Depending upon whether the light path 70 is interrupted by the third segment 66, the position detector 67 detects the position of the moving member 62.

As the moving member 62 rotates about the detection shaft 63, the moving member 62 is selectively placed in a third position (see FIG. 4), a fourth position indicated by a solid line in FIG. 5, and a fifth position indicated by a dotted line in FIG. 5. When the moving member 62 is in the third position as shown in FIG. 4, the first and second segments 64, 65 are diagonally oriented front/up-ward, and the third segment 66 horizontally rearward. When the moving member 62 is held in such a position, the third segment 66 is out of the light path 70 and does not interrupt the detection light to be received at the light receiving section 69. When the moving member 62 is in the fourth position as shown in FIG. 5, the first and second segments 64, 65 are oriented upward, and the third segment 66 diagonally rear/down-ward. When the moving member 62 is held in such a position, the third segment 66 is disposed between the light emitting section 68 and the light receiving section 69 to interrupt the detection light. When the moving member 62 is in the fifth position as shown by a dotted line in FIG. 5, the first and second segments 64, 65 are diagonally oriented rear/up-ward, and the third segment 66 downward. At this time, the third segment 66 is out of the light path 70.

Referring to FIGS. 4 and 5, the moving member 62 sequentially takes the third, fourth and fifth positions when rotated clockwise as viewed from the right side. The moving member 62 is urged to be in the third position as shown in FIG. 4 by an urging member (not shown).

When the process unit 13 is unloaded from the main casing 2, the moving member 62 is in the third position and the position detector 67 detects such a positioning. To load the process unit 13 into the main casing 2, the user first opens the front cover 5, grasps the drum grip 51 and the developer grip 54 to bring the process unit 13 into the internal space 2A of the main casing 2. When the process unit 13 is further brought forward into the main casing 2, the downwardly protruded portion 37A formed in the bottom wall 37 of the drum cartridge 18 is brought into engagement with the corresponding protruded portion 71 formed in the unit frame 61. At this time, the lower end portion 56A of the extension portion 56 of the right side pressing member 50 is brought into abutment with the second segment 65 of the moving member 62 held in the third position. As a result, the moving member 62 rotates clockwise as viewed from the right side against the urging force applied by the urging member (not shown).

When the protruded portion 37A of the drum cartridge 18 is engaged with the corresponding protruded portion 71 of the unit frame 61, the process unit 13 is no longer movable forwardly. This completes loading the process unit 13 in the main casing 2. At this time, rotations of the moving member 62 stop and the moving member 62 is placed in the fourth position. That is, when the process unit 12 is loaded in the main casing 2, the moving member 62 is brought to the fourth position by the pressing member 50 placed in the second position. At this time, the process unit 12 is brought into abutment with the pressing member 50.

In this manner, when the moving member 62 is moved from the third position to the fourth position, the third segment 66 of he moving member 62 moves into the light path 70 to interrupt the detection light. The position detector 67 thus detects that the moving member 62 is in the fourth position. It should be noted that a CPU 90 functioning as a determination unit is disposed in the main casing 2 as shown in FIG. 1. The CPU 90 determines that the process unit 13 is loaded in the main casing 2 based on the detection result indicating that the moving member 62 is in the fourth position.

On the other hand, to unload the process unit 13 from the main casing 2, the process unit 13 is drawn frontward while gripping the drum grip 51 and the developer grip 54. When the process unit 13 is completely unloaded from the main casing 2, the moving member 62 returns to the third position by the urging force imparted by the urging member (not shown), and the position detector 67 detects that the moving member 62 has moved to the third position.

A major part of the process unit 13 is loaded in or unloaded from the main casing 2 through a space 95 above a reference line 96 (see FIG. 4). The moving member 62 is located below the reference line 96 wherever the position of the moving member 62 may be.

In a state where the pressing member 50 is in the second position and the moving member 62 is in the fourth position, line lengths A and B on the vertical cross section as shown in FIG. 5 will be defined as follows. The line length A is defined as a length between a first contact point X and the first rotation center of the pressing member (center axis 58A of the pressing shaft 58). The first contact point X is defined as a contact point between the pressed member 80 of the developing cartridge 19 and the pressing potion 55 of the pressing member 50. The second line length B is defined as a length between a second contact point Y and the first rotation center. The second contact point Y is defined as a contact point between the lower end portion 56A of the pressing member 50 and the second segment 65 of the moving member 62 in the fourth position. It should be noted that the second line length B is set longer than the first line length A.

A third contact point Z is defined as a contact point between the second segment 65 of the moving member 62 in the fourth position and the lower end portion 56A of the pressing member 50 in the second position. A third line length C is defined as a length between the third contact point Z and a second rotation center. The second rotation center is a center axis 63A of the detection shaft 63. A fourth line length D is defined as a line length between the third segment 66 (strictly, the end 66A of the third segment 66 farthest from the axial center 63A) of the moving member 62 and the center axis 63A of the detection shaft 63. It should be noted that the fourth line length D is longer than the third line length C. As viewed from the widthwise direction, the third segment 66 is disposed at the opposite side of the third contact point Z with respect to the center axis 63A of the detection shaft 63. The second and third contact points Y and Z are in coincidence with each other as viewed from the widthwise direction.

The printer 1 is ready for printing when the process unit 13 is loaded in the main casing 2 and the front cover 5 is closed. When printing is performed, a sheet of paper P (which is an example of a recording medium) passes through the conveying path 36. When the sheet of paper P is conveyed to the moving member 62 placed in the fourth position as indicated by a solid line, the sheet P is brought into contact with and overrides the first segment 64. This causes the moving member 62 to rotate clockwise as viewed from the right side against the urging force imparted by the urging member (not shown). As a result, the moving member 62 moves from the fourth position to the fifth position as indicated by a dotted line.

The third segment 66 that has been placed in the light path 70 when the moving member 62 is in the fourth position is moved out of the light path 70 resulting from the movement of the moving member 62 from the fourth position to the fifth position. The position detector 67 detects that the moving member 62 has moved to the fifth position. As described previously, the first segment 64 of the moving member 62 that is projected into the conveying path 36 is positioned upstream of the registration rollers 11 with respect to the sheet conveying direction. Based on the detection result obtained from the position detector 67 indicating that the moving member 62 is in the fifth position, the CPU 90 determines a timing at which the registration rollers 11 convey the sheet of paper in contact with the first segment 64 toward the transfer position. The registration rollers 11 convey the paper P toward the transfer position at the timing determined by the CPU 90. In this sense, the moving member 62 functions as a passage detector for detecting passage of the sheet of paper P at a prescribed point in the conveying path 36.

As described above, the moving member (passage detector) 62 detects passage of the paper P along the conveying path 36 with the first segment 64 thereof. Upon detection of the passage of the paper P, the moving member (passage detector) 62 moves to the fifth position in which the first segment 64 is placed within the unit frame 61 of the feed unit 60 and out of the conveying path so as not to bother the passage of paper P in the conveying path 36.

When the paper P has passed the first segment 64, the moving member passage detector) 62 is rotated counterclockwise by the force of the urging member (not shown) and returned to the fourth position. The moving member 62 stops at the fourth position as it is brought into abutment with the lower end portion 56A of the pressing member 50 disposed at the second position. The position detector 67 thus detects that the moving member 62 is in the fourth position.

As described in detail above, the pressing member 50 is provided in the drum cartridge 18 to be movable between the first position and the second position. The pressing member 50 is placed in the first position when the developing cartridge 19 is dismounted from the drum cartridge 18 whereas the pressing member 50 is placed in the second position when the developing cartridge 19 is perfectly mounted on the drum cartridge 18. The moving member 62 and the position detector 67 are provided in the main casing 2. The moving member 62 is in the third position when the process unit (the drum cartridge 18 on which the developing cartridge 19 is mounted) is unloaded from the main casing 2. On the other hand, the moving member 62 is moved to the fourth position when a perfectly assembled process unit is loaded in the main casing 2. At this time, the pressing member 50 placed in the second position is brought into abutment with the moving member 62, causing the moving member 62 to move to the fourth position. The position detector 67 detects the position of the moving member 62.

The CPU 90 determines that the drum cartridge 18 on which the developing cartridge 19 is mounted is loaded in the main casing 2 based on the detection result of the position detector 67 indicating that the moving member 62 is in the fourth position. The pressing member 50 is not placed in the second position but in the first position if the developing cartridge 19 is not mounted on the drum cartridge 18. Accordingly, the moving member 62 is not moved to the fourth position but remains in the third position if only the drum cartridge 18 is loaded in the main casing 2. The CPU 90 thus determines that either one of the two cartridges is loaded in the main casing 2 but the remaining one of the cartridges is not loaded therein based on the detection result from the position detector 67 indicating that the moving member 62 is in the third position.

When the drum cartridge 18 is not loaded in the main casing 2 but only the developing cartridge 19 is loaded therein, the pressing member 50 is not present so that the moving member 62 is not brought to the fourth position but remains in the third position. Based on the detection result from the position detector 67, the CPU 90 determines that either one of the two cartridges is loaded in the main casing 2 but the remaining one of the cartridges is not.

The main casing 2 is provided with an informing unit 91 for informing the user of various errors (see FIG. 1). When the CPU 90 detects an error (for example, at least one of the drum cartridge 18 and the developing cartridge 19 has been loaded in the main casing 2), the informing unit 91 informs the user about the occurrence of the error with a prescribed method before the image formation is performed (for example, when the front cover 5 is closed). Such a prescribed method may include a warning lamp, a warning sound or an error display. In this way, the informing unit 91 prompts the user to remove the error as early as possible once the error has occurred.

In the above-described embodiment, a first distance A from a first contact point X between the pressing member in the second position and the pressed member 80 to a first rotation center 58A of the pressing member is equal to or shorter than a second distance B from a second contact point Y between the moving member 62 and the pressing member 50 to the first rotation center 58A. A third distance C from a third contact point Z between the pressing member 50 in the second position and the moving member 62 to a second rotation center 63A of the moving member 62 is equal to or shorter than a fourth distance D between a portion disposed in opposite side of the third contact point Z relative to the second rotation center 63A, the portion being detected by the position detector, and the second rotation center. As such, even if the amount of displacement of the pressing member 50 between the first position and the second position is small (in the embodiment described, the rotation angle of the pressing member 50 between the first position and the second position is about 9 degrees), the second contact point Y of the pressing member 50, which point is relatively largely displaced or rotated, is brought into abutment with the third contact point Z. Thus, the movement of the moving member 62 between the third position and the fourth position is assured. Furthermore, even if the amount of displacement of the moving member 62 between the third position and the fourth position is small, positional detection of the moving member 62 by the position detector 67 can be assured because the third segment 66 to be detected by the position detector 67 is relatively largely displaceable as compared with other segments of the moving member 62.

In other words, augmenting a small displacement of the pressing member 50 enables accurate detection of the first and second positions of the pressing member 50 and the third and fourth positions of the moving member 62.

While the invention has been described in detail with reference to the embodiment thereof, it would be apparent to those skilled in the art that various changes and modifications may be made therein without departing from the spirit of the invention.

Figure 8:
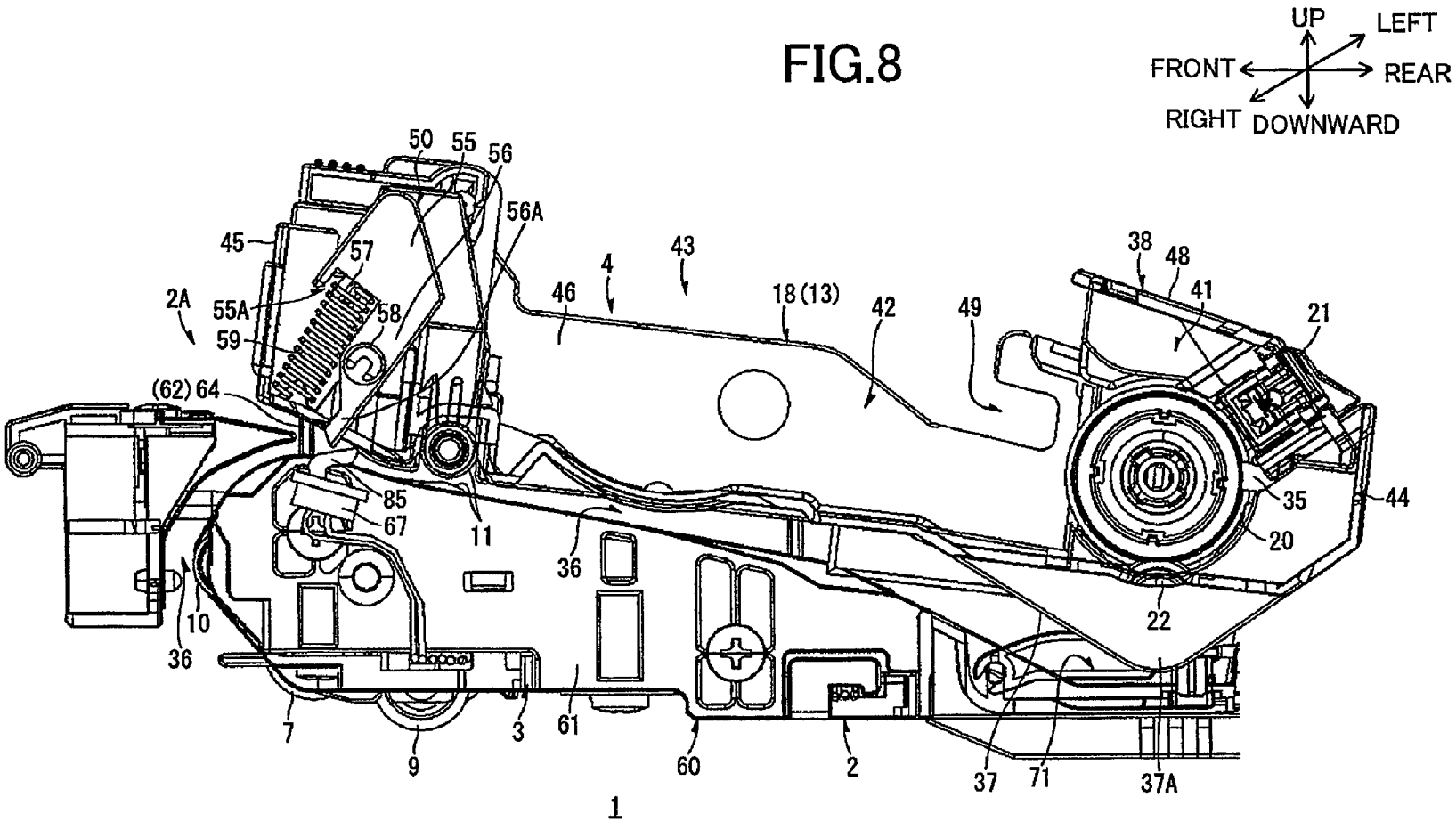
FIG. 8 is a vertical cross-sectional view showing a major portion around the process unit mounted to a laser printer in accordance with a modification of the invention, in which the developing cartridge is dismounted from the drum cartridge.
Figure 9:
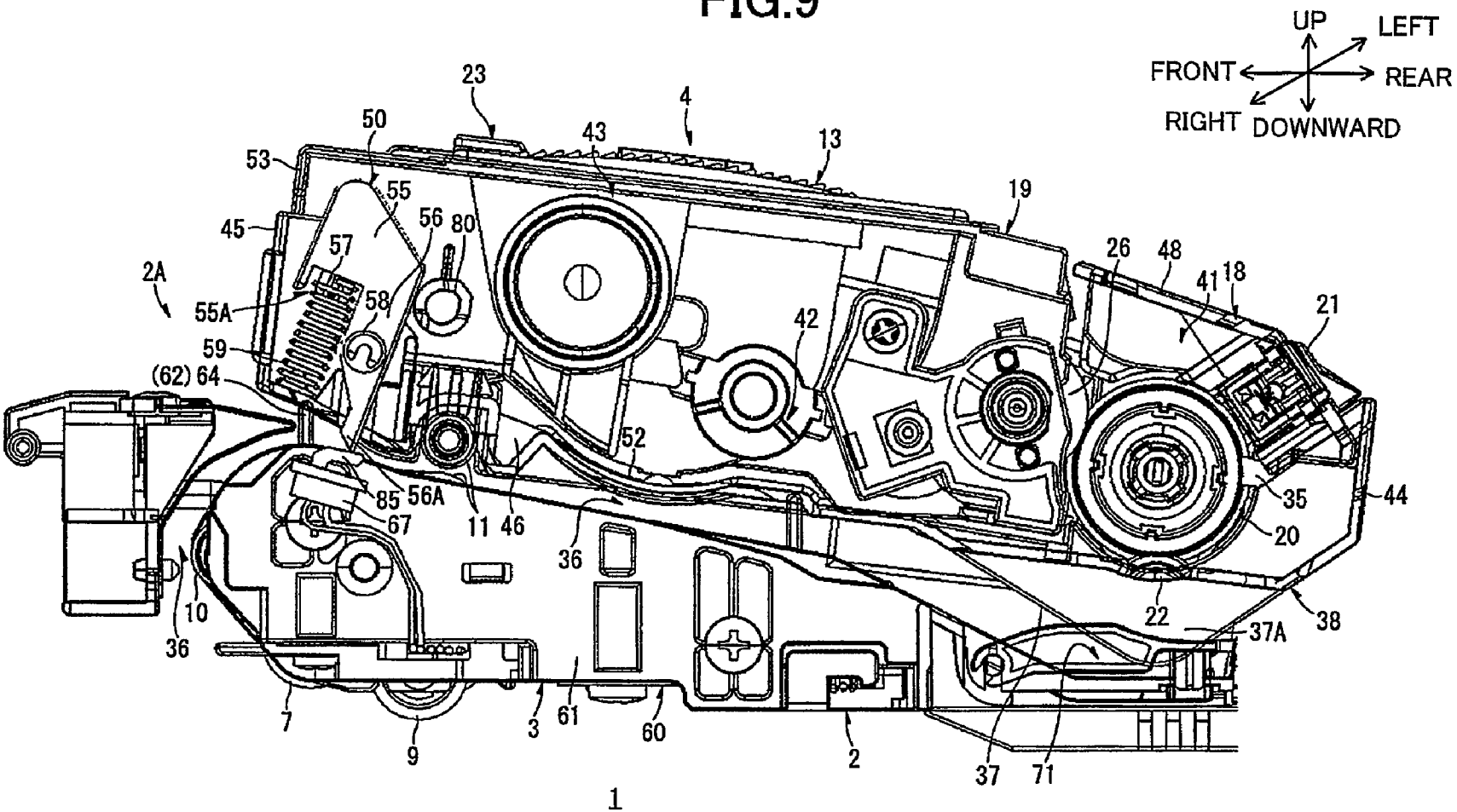
FIG. 9 is a vertical cross-sectional view showing a major portion around the process unit mounted to a laser printer in accordance with the modification of the invention, in which the developing cartridge is mounted on the drum cartridge.

A modification is shown in FIGS. 8 and 9. FIG. 8 shows a state in which a drum cartridge and a developing cartridge are separated and FIG. 9 shows a state in which the developing cartridge is mounted on the drum cartridge.

Figure 6:
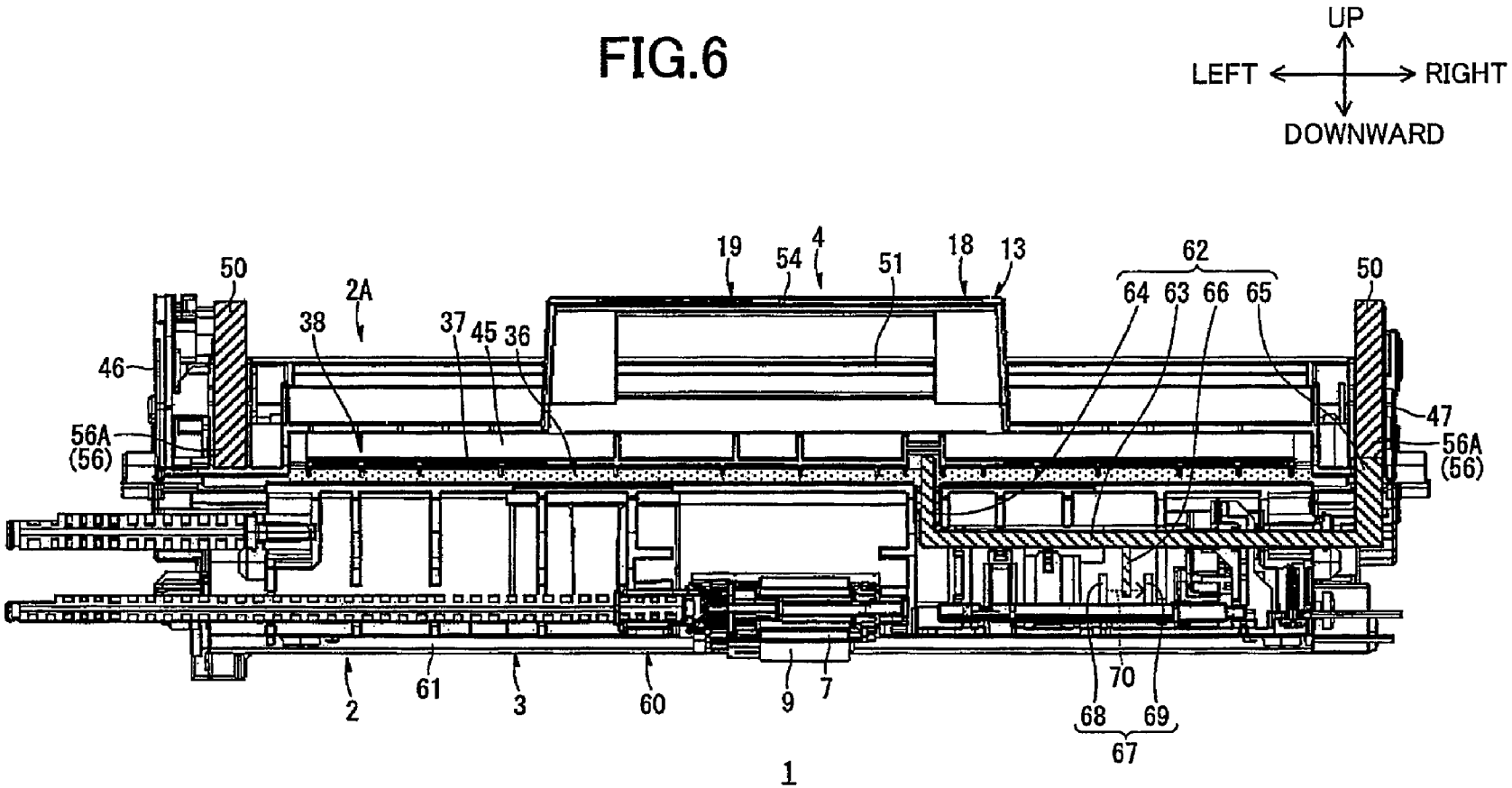
FIG. 6 is a cross-sectional view showing the process unit and a feed unit provided in the laser printer shown in FIG. 1.

The embodiment described above employs an optical sensor as the position sensor 67 as shown in FIG. 6. The modification employs a contact switch as the position sensor as shown in FIGS. 8 and 9. The position sensor 67 in accordance with the modification is configured from a lever 85 disposed immediately below the lower end portion 56A of the pressing member 50 when the process unit 13 is loaded in the main casing 2. The lever 85 is deformable and capable of moving between the third position and the fourth position. The third and fourth positions of the lever 85 correspond to the third and fourth positions of the moving member 62 described in the embodiment. FIG. 8 shows that the lever 85 is in the third position where the lever 85 extends rear-up-ward. FIG. 9 shows that the lever 85 is in the fourth position where the lever 85 extends rear-down-ward. When the pressing member 50 is in the second position (see FIG. 9), the lower end portion 56A of the pressing member 50 is oriented downward as compared to the case where the pressing member 50 is in the first position (see FIG. 8). Similar to the moving member 62 according to the above-described embodiment, the lever 85 also functions as a moving member.

The position sensor 67 is rendered OFF in which the position sensor 67 is in an electrically disconnected state when the lever 85 is in the third position. On the other hand, the position sensor 67 is rendered ON in which the position sensor 67 is in an electrically disconnected state when the lever 85 is moved to the fourth position. The position of the lever 85 is detected based on whether or not the position sensor 67 is ON or OFF, i.e., whether the position sensor 67 is in the electrically connected state or disconnected state. The relation between the positions of the lever 85 and the ON and OFF states of the position sensor 67 can be reversed. Specifically, the position sensor 67 may be rendered ON in which the position sensor 67 is in an electrically connected state when the lever 85 is in the fourth position. On the other hand, the position sensor 67 may be rendered OFF in which the position sensor 67 is in an electrically disconnected state when the lever 85 is in the third position.

With the above-described structure according to the first embodiment, when only the drum cartridge 18 or only the developing cartridge 19 is loaded in the main casing 2, the lower end portion 56A of the pressing member 50 is apart from the lever 85 and thus the lever 85 remains in the third position. Thus, the position detector 67 is OFF, based on which it can be detected that the lever 85 is in the third position.

On the other hand, when the drum cartridge 18 on which the developing cartridge 19 is mounted, i.e., the completed process unit 13, is loaded in the main casing 2, the lower end portion 56A of the pressing member 50 in the second position is brought into contact with the lever 85, causing the lever 85 to press downward. As a result, the lever 85 is moved to the fourth position and thus the position detector 67 is rendered ON, based on which it can be detected that the lever 85 is in the fourth position.

The modification is advantageous in that the position of the lever 5 can be easily detected depending upon whether or not the contact switch acting as the position detector 67 is rendered ON or OFF.

While the above-described embodiment shows a monochromatic laser printer as one embodiment, the present invention is applicable not only to such a laser printer but also a color laser printer or other types of color image forming devices. Further, the above-described embodiment employs an exposure unit for exposing the photosensitive drum 20 to laser beam. Another type of exposure unit may be employed instead. For example, the exposure unit may include a plurality of LEDs aligned along the longitudinal axis of the photosensitive drum 20, in which the LEDs are selectively lit based on image data instead of scanning the laser beam modulated based on image data.

In the above described embodiment and modifications, the present invention has been applied to the process unit 13 (the drum cartridge 18 and the developing cartridge 19). However, the present invention may also encompass other combinations of cartridges, such as a toner cartridge that accommodates toner therein and a developing unit that includes a developing roller and a supply roller for supplying toner to the developing roller.

Further, the printer 1 is provided with the informing unit 91 for informing the user of errors. However, the printer 1 may not have the informing unit 91. In the latter case, an informing unit may be provided on a computer to which the printer 1 is connected. Upon detection of an error, the printer 1 outputs a signal to the computer to indicate occurrence of the error. In response to such an error signal, the computer informs the user of the error with a prescribed method (an error display, for example).

What is claimed is:

1. An image forming device comprising:

a main casing;

a cartridge accommodating portion that is configured to detachably accommodate a first cartridge and a second cartridge that is able to be detachably combined with the first cartridge to form a combined unit, the first cartridge being provided with a pressing member movable between a first position and a second position, the pressing member being in the first position when the second cartridge is removed from the first cartridge, the pressing member being in the second position when the second cartridge is combined with the first cartridge;

a moving member supported on the main casing to be movable between a third position and a fourth position, the moving member being in the third position when the combined unit is unloaded from the main casing, the moving member being in the fourth position when the combined unit is loaded in the main casing wherein the pressing member disposed in the second position presses the moving member to move to the fourth position;

a position detector that is provided on the main casing and is configured to detect a position of the moving member; and a determination unit that is configured not to start image forming operations until the position detector detects that the moving member is in the fourth position.

2. The image forming device according to claim 1, wherein the first cartridge is a drum cartridge including a photosensitive drum, and the second cartridge is a developing cartridge including a developing roller that is urged against the photosensitive drum by the pressing member when the photosensitive drum and the developing cartridge are combined.

3. The image forming device according to claim 2, further comprising a conveying path along which a recording medium is conveyed in a direction, wherein the moving member is further movable to a fifth position when the recording medium has passed a first point in the conveying path.

4. The image forming device according to claim 3, further comprising a pair of rollers disposed in a second point in the conveying path, the second point being downstream of the first point with respect to the direction in which the recording medium is conveyed, wherein the determination unit is further configured to determine a timing at which the pair of rollers start conveying the recording medium further in the direction when the position detector detects that the moving member is in the fifth position.

5. The image forming device according to claim 3, wherein the position detector includes a light emitting section that emits light and a light receiving section that receives the emitted light, the position detector being configured to detect the position of the moving member based on whether the light receiving section receives the light.

6. The image forming device according to claim 5, wherein the moving member is out of a light path between the light emitting section and the light receiving section to allow the light receiving section to receive the light emitted from the light emitting section when the moving member is in the third position and the fifth position whereas the moving member is in the light path to block the light emitted from the light emitting section from being received at the light receiving section when the moving member is in the fourth position.

7. The image forming device according to claim 3, wherein the moving member includes a first portion disposed in the conveying path and acting as a passage detector for detecting passage of the recording medium, and a second portion disposed out of the conveying path and in abutment with the pressing member.

8. The image forming device according to claim 2, further comprising a pressed member to be pressed by the pressing member, the pressed member being provided in the drum cartridge, wherein the pressing member is rotatably movable to the first position and to the second position, and the moving member is rotatably movable to the third position and the fourth position, wherein a first distance from a first contact point between the pressing member in the second position and the pressed member to a first rotation center of the pressing member is equal to or shorter than a second distance from a second contact point between the moving member and the pressing member to the first rotation center, and wherein a third distance from a third contact point between the pressing member in the second position and the moving member to a second rotation center of the moving member is equal to or shorter than a fourth distance between a portion disposed on an opposite side of the third contact point relative to the second rotation center, the portion being detected by the position detector, and the second rotation center.

9. The image forming device according to claim 1, wherein the position detector comprises a point switch that detects the position of the moving member depending upon whether current is allowed to flow in the contact switch.

10. The image forming device according to claim 1, wherein the moving member is disposed in a position apart from an accessing path through which the combined unit is loaded in the main casing.

11. The image forming device according to claim 1, further comprising an informing unit that informs a user that at least one of the first cartridge and the second cartridge has not been loaded in the main casing when the detection unit detects that the pressing member is in the first position.

12. The image forming device according to claim 1, wherein the determination unit is further configured to output, to a computer connectable to the image forming device, signals indicative of loading status of the first cartridge and the second cartridge, the computer including an informing unit that informs a user of the loading status of the first cartridge and the second cartridge in response to the signals outputted from the determination unit.

* * * * *